US008764005B2

(12) United States Patent
Tajima

(10) Patent No.: US 8,764,005 B2
(45) Date of Patent: Jul. 1, 2014

(54) RECORDING MEDIUM FEEDING DEVICE AND RECORDING APPARATUS

(71) Applicant: Seiko Epson Corporation, Tokyo (JP)

(72) Inventor: Hiroyuki Tajima, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/849,055

(22) Filed: Mar. 22, 2013

(65) Prior Publication Data

US 2013/0285308 A1 Oct. 31, 2013

(30) Foreign Application Priority Data

Apr. 27, 2012 (JP) ..... 2012-103318

(51) Int. Cl.
*B65H 3/06* (2006.01)

(52) U.S. Cl.
USPC ..... 271/117; 271/118

(58) Field of Classification Search
USPC ..... 271/117, 118
See application file for complete search history.

(56) References Cited

U.S. PATENT DOCUMENTS

| | | | | |
|---|---|---|---|---|
| 5,377,969 | A * | 1/1995 | Steinhilber | 271/21 |
| 6,991,227 | B2 * | 1/2006 | Kim | 271/10.12 |
| 7,249,760 | B2 * | 7/2007 | Liu et al. | 271/114 |
| 7,963,519 | B2 * | 6/2011 | Bokelman et al. | 271/117 |
| 2007/0001374 | A1 * | 1/2007 | Lee | 271/117 |
| 2011/0241282 | A1 * | 10/2011 | Nishinakama et al. | 271/117 |

FOREIGN PATENT DOCUMENTS

| | | |
|---|---|---|
| JP | 2008-068949 | 3/2008 |
| JP | 4237346 | 12/2008 |

* cited by examiner

*Primary Examiner* — Kaitlin Joerger
(74) *Attorney, Agent, or Firm* — Workman Nydegger

(57) ABSTRACT

A recording medium feeding device includes a first support member that supports a feed roller and is configured to be swingable about a pivot shaft so that the first support member swings to displace the feed roller in directions to and away from the recording medium, a first engagement section that includes a gear that swings with the first support member, and a second engagement section that is engageable with the first engagement section when the first support member swings to move the feed roller away from the recording medium, wherein engagement of the first engagement section and the second engagement section is maintained in a state where a power in a swing direction is not transmitted to the first support member, and engagement of the first engagement section and the second engagement section is released when the power in the swing direction is transmitted to the first support member.

7 Claims, 7 Drawing Sheets

RECORDING MEDIUM FEEDING DEVICE AND RECORDING APPARATUS

BACKGROUND

1. Technical Field

The present invention relates to a recording medium feeding device and a recording apparatus having the same. The recording apparatus described herein is intended to include an ink jet printer, a line printer, a copy machine, a facsimile machine and the like.

2. Related Art

In a recording apparatus such as an ink jet printer, a recording medium is placed on a loading surface disposed in a sheet feeding device. Then, the recording medium is transported by a feed roller from the loading surface to a recording section which is disposed at a position downstream of a feeding path so that recording is performed in the recording section. After recording is performed in the recording section, the recording medium is ejected from the recording apparatus by an ejection unit.

In such a recording apparatus, for example, as disclosed in Japanese Patent No. 4237346, a feed roller is disposed at a position that opposes the loading surface on which the recording medium is placed, and is configured to move onto and away from the recording medium which is placed on the loading surface.

If the feed roller in a feeding device is configured to be in contact with the recording medium even during the time that the feed roller does not feed the recording medium, it may cause a problem in that additional recording media may not be easily set, or the recording medium may have deformation, damage or smudge due to the feed roller which is in contact with the surface of the recording medium for an extended period of time. Accordingly, the above recording apparatus is configured such that the feed roller is moved away from the recording medium during the time that the feed roller does not feed the recording medium.

However, the above recording apparatus needs a mechanism to move the feed roller away from the recording medium and to maintain the feed roller in a separated state, which causes the apparatus to be complicated or increased in size.

SUMMARY

An advantage of some aspects of the invention is that a recording medium feeding device that is capable of moving the feed roller away from the recording medium and maintaining the separated state with a simple configuration while reducing the apparatus size is provided.

According to a first aspect of the invention, a recording medium feeding device includes a feed roller that feeds a recording medium by rotating while coming into contact with the recording medium, a first support member that supports the feed roller and is configured to be swingable about a pivot shaft so that the first support member swings to displace the feed roller in directions to and away from the recording medium, a first engagement section that is formed by a gear that swings with the first support member, and a second engagement section that is engageable with the first engagement section when the first support member swings to move the feed roller away from the recording medium, wherein engagement of the first engagement section and the second engagement section is maintained in a state where a power in a swing direction is not transmitted to the first support member, and engagement of the first engagement section and the second engagement section is released when the power in the swing direction is transmitted to the first support member.

Accordingly, engagement of the first engagement section disposed on the first support member that displaces the feed roller in directions to and away from the recording medium and the second engagement section fixedly provided is maintained in a state where a power in a swing direction is not transmitted to the first support member. Then, when the power in the swing direction is transmitted to the first support member, engagement of the first engagement section and the second engagement section is released. Therefore, it is possible to maintain the feed roller in the state moved away from the recording medium with a simple configuration, thereby reducing the size of the apparatus.

In the recording medium feeding device according to the aspect, engagement of the first engagement section and the second engagement section is established when the power in the swing direction is transmitted to the first support member.

In the recording medium feeding device according to the aspect, the first engagement section is formed by a pinion gear with a rotational friction resistance applied thereto, and the second engagement section is formed by a rack that mates with the pinion gear.

Accordingly, since the first engagement section and the second engagement section are engaged by the pinion gear and the rack mating with each other, it is possible to reduce abrasion of the first engagement section and the second engagement section due to repeated engagement and disengagement of both engagement sections, thereby maintaining a good engagement of the first engagement section and the second engagement section.

In the recording medium feeding device according to the aspect, the rack has a plurality of teeth.

Accordingly, since the rack has a plurality of teeth, even if the pinion gear is disengaged from one of the teeth of the rack due to an external factor such as vibration, the pinion gear engages with the next tooth, thereby maintaining engagement.

In the recording medium feeding device according to the aspect, a swing range of the first support member is limited between a position in which the feed roller is in contact with the recording medium and a position in which the first engagement section engages with the second engagement section, when a plurality of recording media are continuously fed downstream of a feeding path.

Accordingly, since the swing range is limited when the recording media are continuously fed, it is possible to reduce switching time between the feeding state and the separated state of the feed roller, thereby reducing decrease of throughput caused by waiting the feed roller to be displaced.

In the recording medium feeding device according to the aspect, the pivot shaft is a rotation shaft that rotates by the power, the pinion gear is configured to rotate by the power from the pivot shaft, and a direction in which the pinion gear moves with respect to the rack as the first support member swings when the feed roller is moved away from the recording medium and a direction in which the pinion gear moves with respect to the rack as the pinion gear rotates are the same direction.

Accordingly, since the direction in which the pinion gear moves with respect to the rack as the first support member swings when the feed roller is moved away from the recording medium and the direction in which the pinion gear moves with respect to the rack as the pinion gear rotates are the same direction, the pinion gear does not suffer a significant resistance from the rack when it moves on the rack, and the pinion gear can smoothly move on the rack.

The recording medium feeding device according to the aspect, further includes a second support member having the first engagement section that swings with the first support member, a drive shaft that drives the feed roller, wherein the second support member includes a bias unit that applies a biasing force between the second support member and the drive shaft in a direction that crosses the axial direction of the drive shaft, and the bias unit applies the rotational friction resistance on the pinion gear.

Accordingly, since the bias unit applies the rotational friction resistance on the pinion gear, it is possible to achieve a configuration that applies the rotational friction resistance to the pinion gear in a simple configuration and with a low cost.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
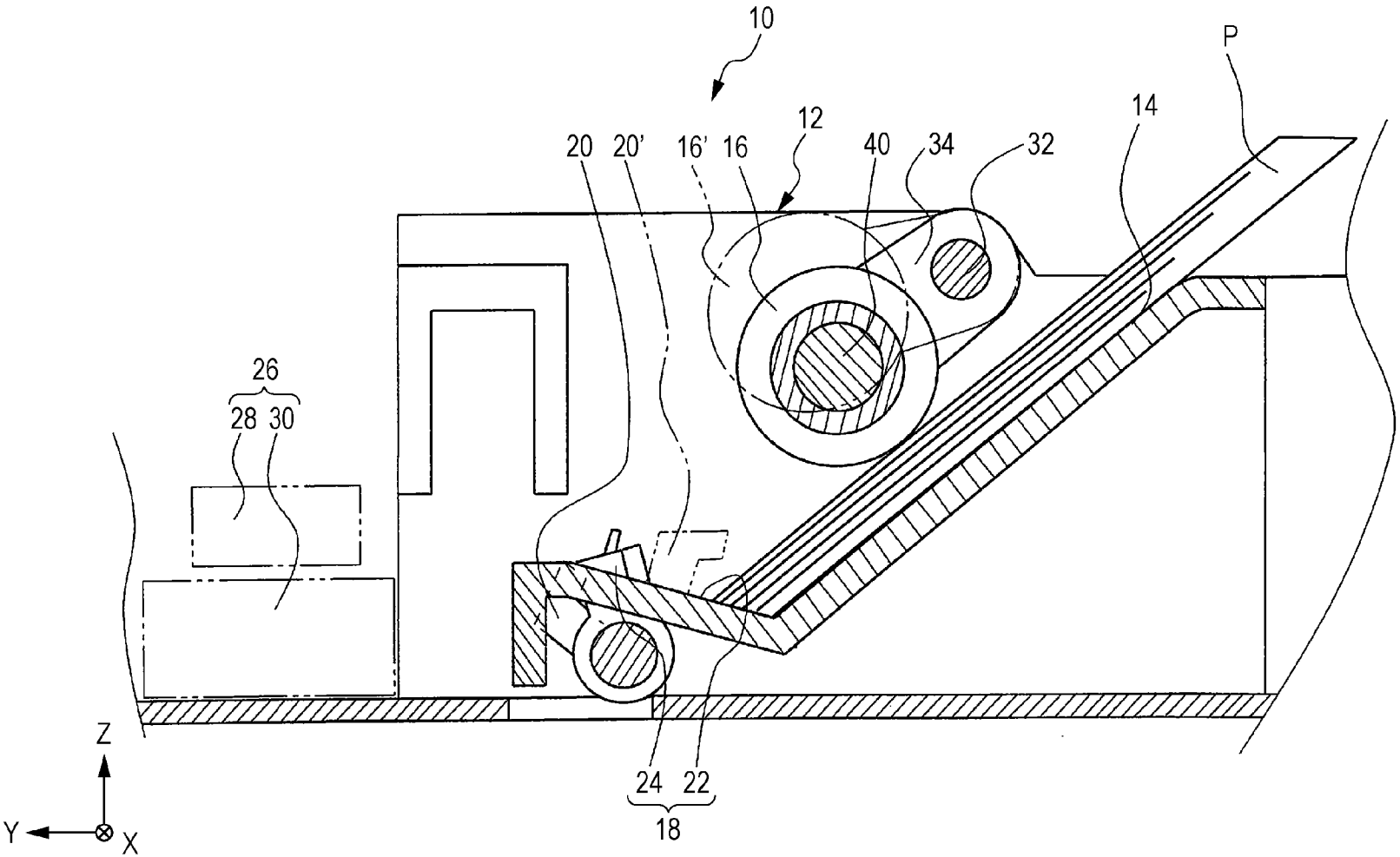
FIG. 1 is a side sectional view of a sheet transportation path of a printer according to the invention.

The embodiments of the invention will be described below with reference to the drawings. The same configurations are denoted by the same reference numerals throughout the embodiments and the description thereof will be provided in a first embodiment only and omitted in the subsequent embodiments.

Figure 2:
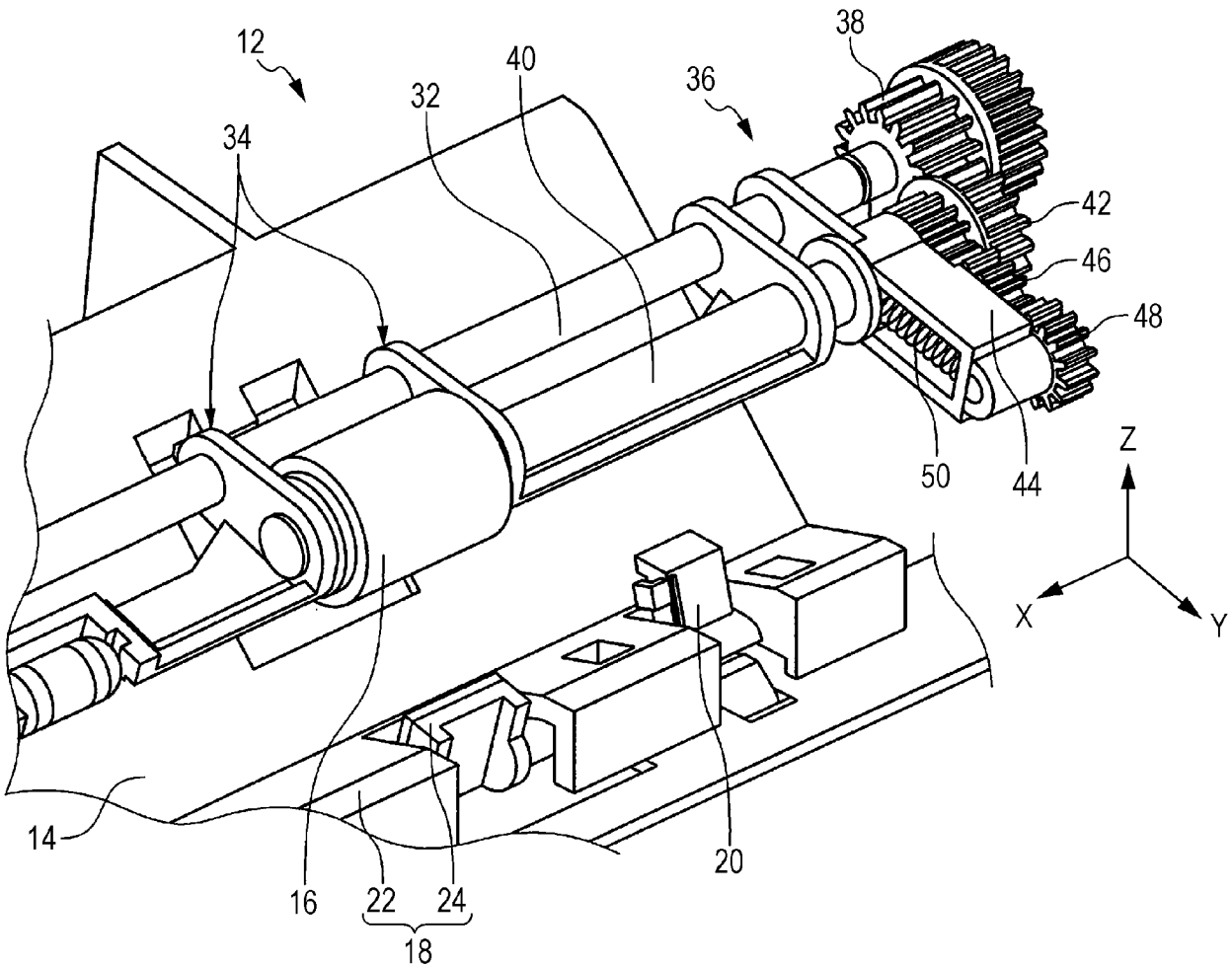
FIG. 2 is a perspective view of a feed roller separation mechanism according to the invention.
Figure 3:
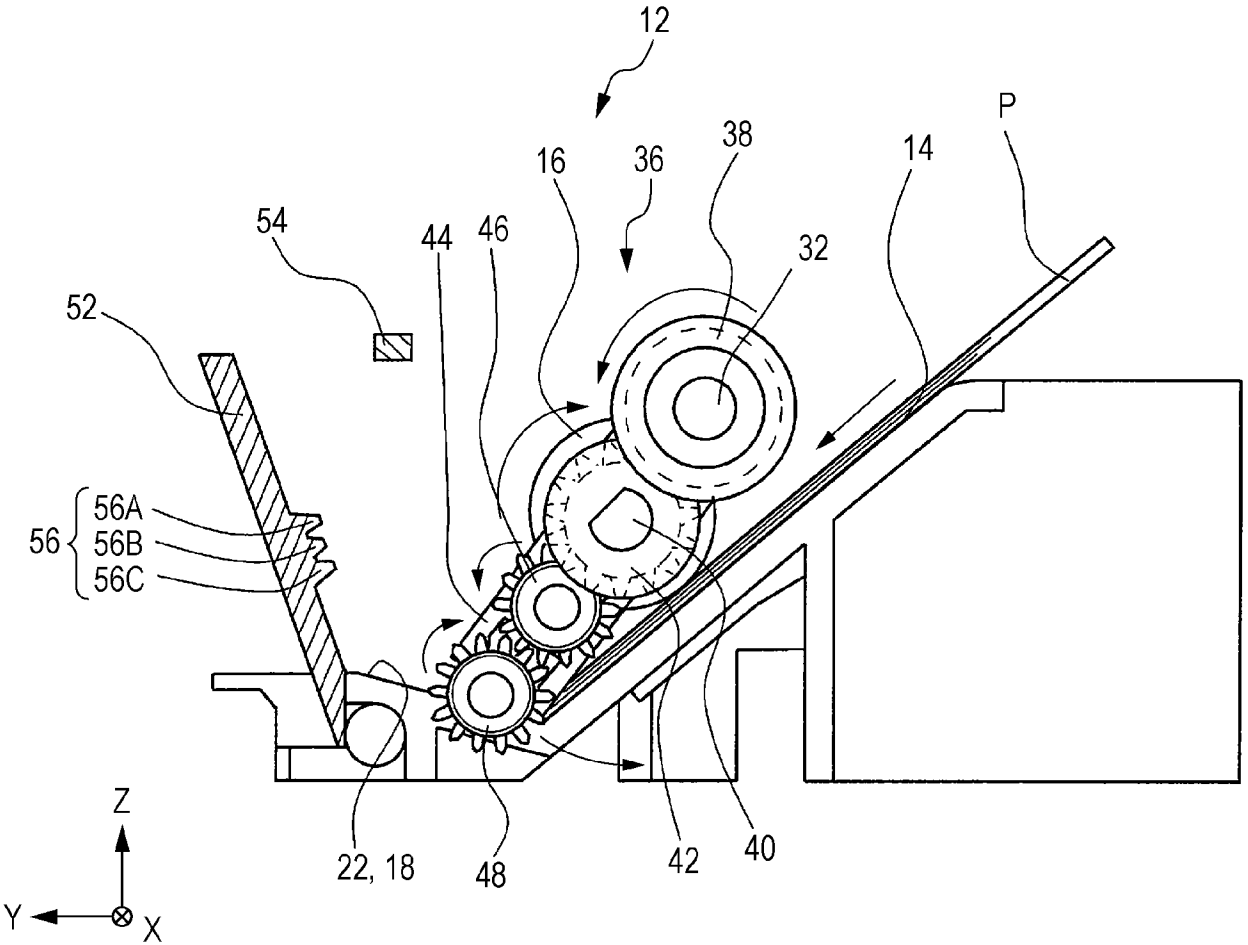
FIG. 3 is a side view which shows a feeding state of the feed roller according to the invention.
Figure 4A:
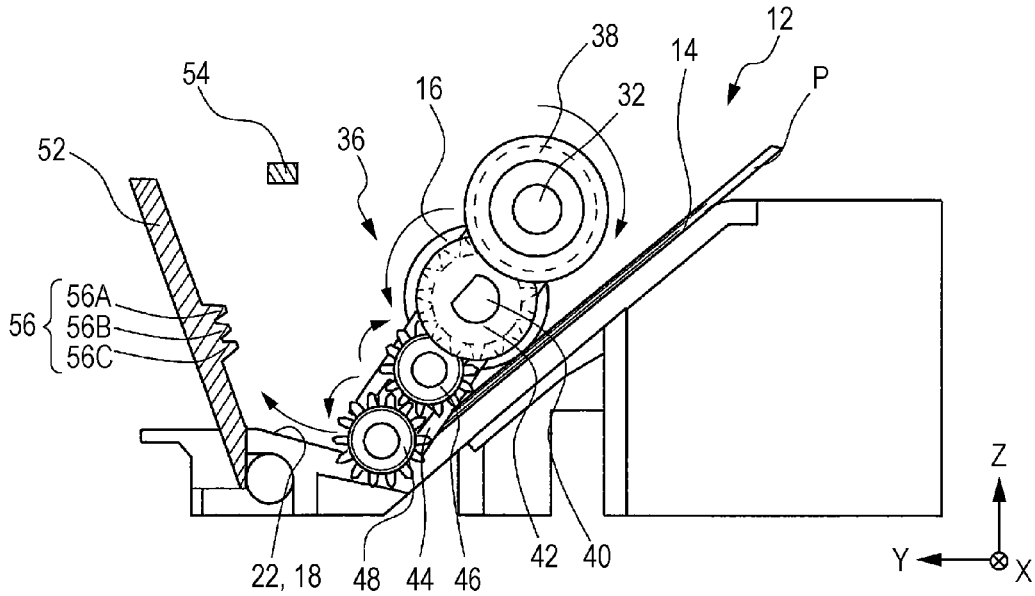
FIG. 4A is a side view of the feed roller which is in a state capable of feeding.
Figure 4B:
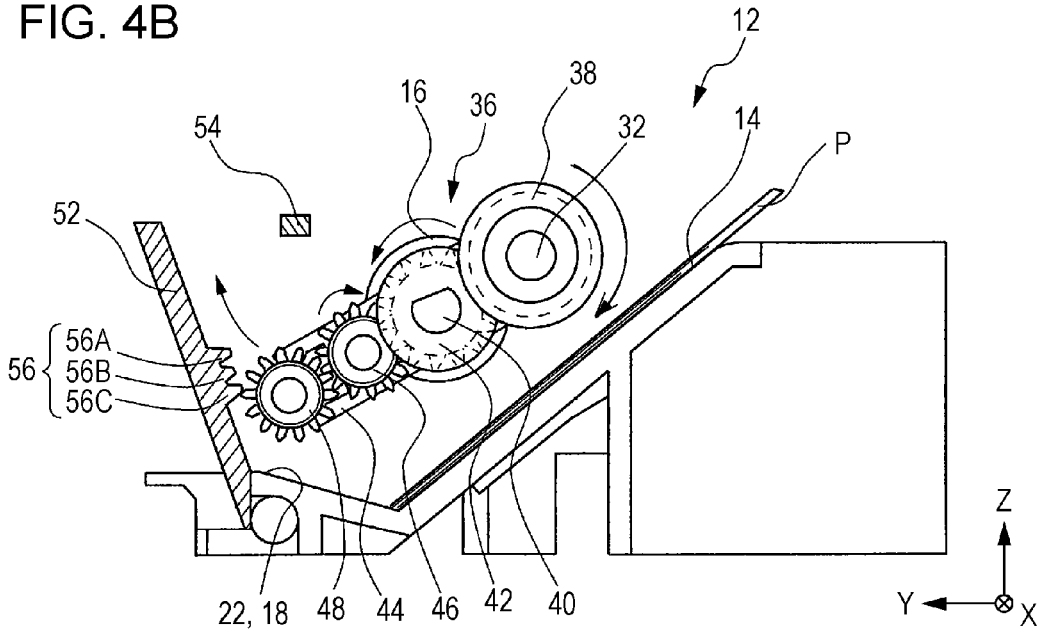
FIG. 4B is a side view of the feed roller separation mechanism which is in a first position of a separating operation from the feeding path.

FIG. 1 is a side sectional view of a sheet transportation path of a printer according to the invention. FIG. 2 is a perspective view of a feed roller separation mechanism according to the invention. FIG. 3 is a side view which shows a feeding state of the feed roller according to the invention. FIG. 4A is a side view of the feed roller which is in a state capable of feeding. FIG. 4B is a side view of the feed roller separation mechanism which is in a first position of a separating operation from the feeding path.

Figure 5A:
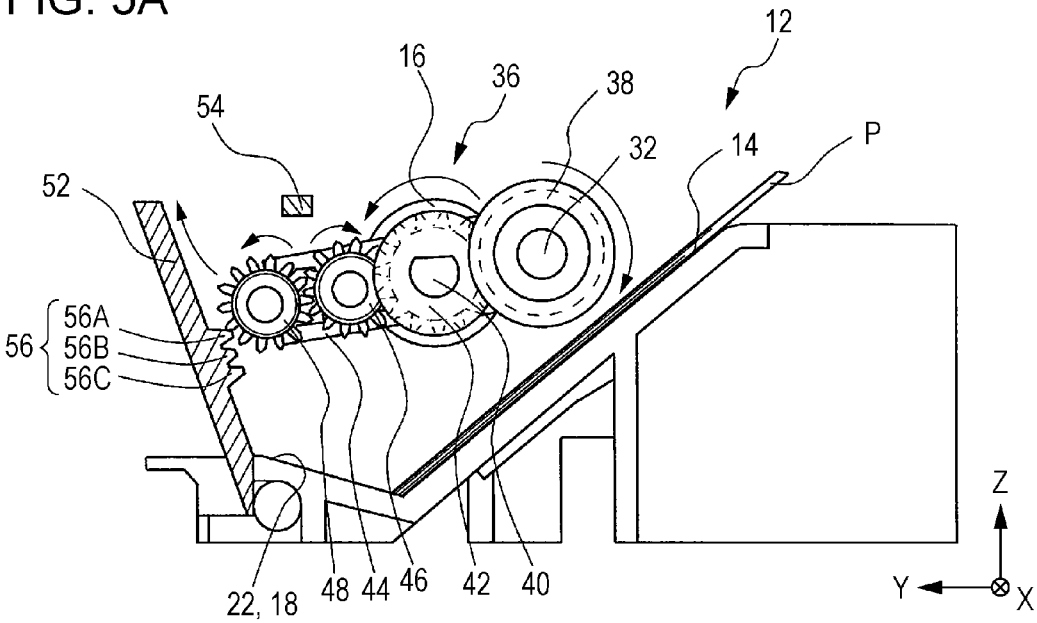
FIG. 5A is a side view of the feed roller separation mechanism which is in a second position of the separating operation from the feeding path.
Figure 5B:
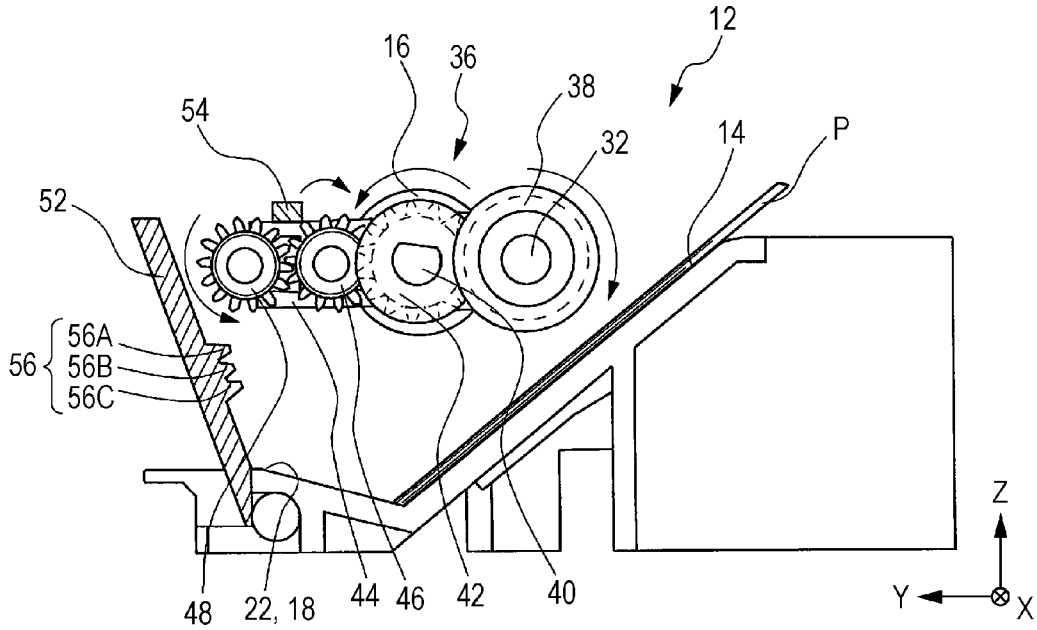
FIG. 5B is a side view of the feed roller separation mechanism which is in a third position of the separating operation from the feeding path.
Figure 6A:
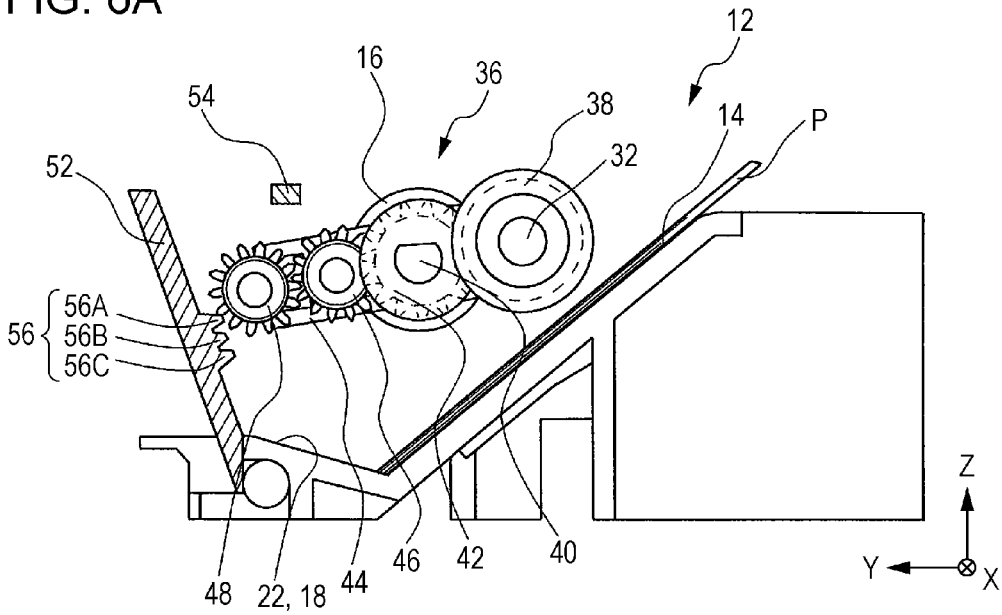
FIG. 6A is a side view of the feed roller separation mechanism which is in an engagement state.
Figure 6B:
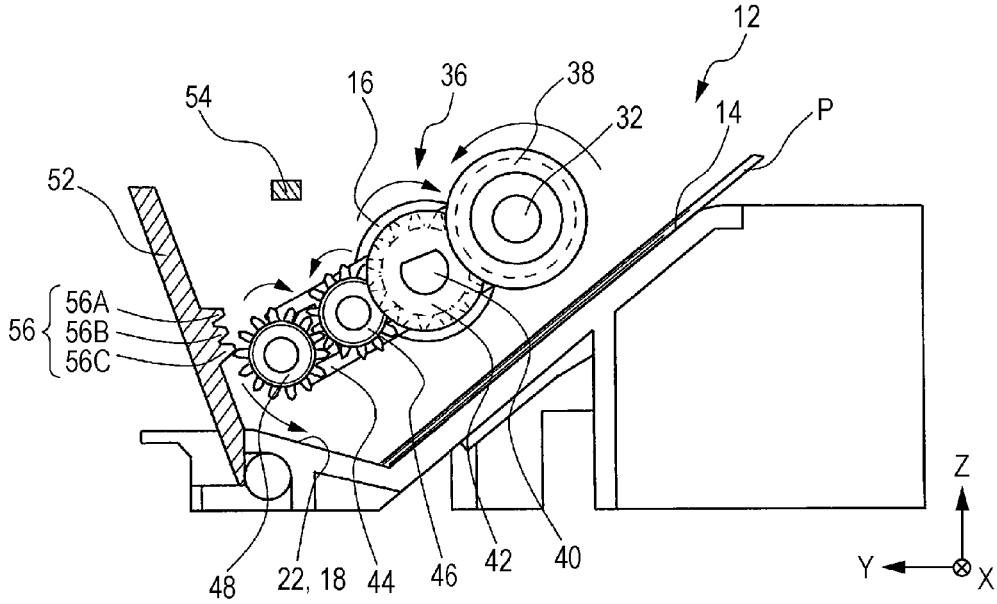
FIG. 6B is a side view of the feed roller separation mechanism which is released from the engagement and is moving toward a recording medium.
Figure 7A:
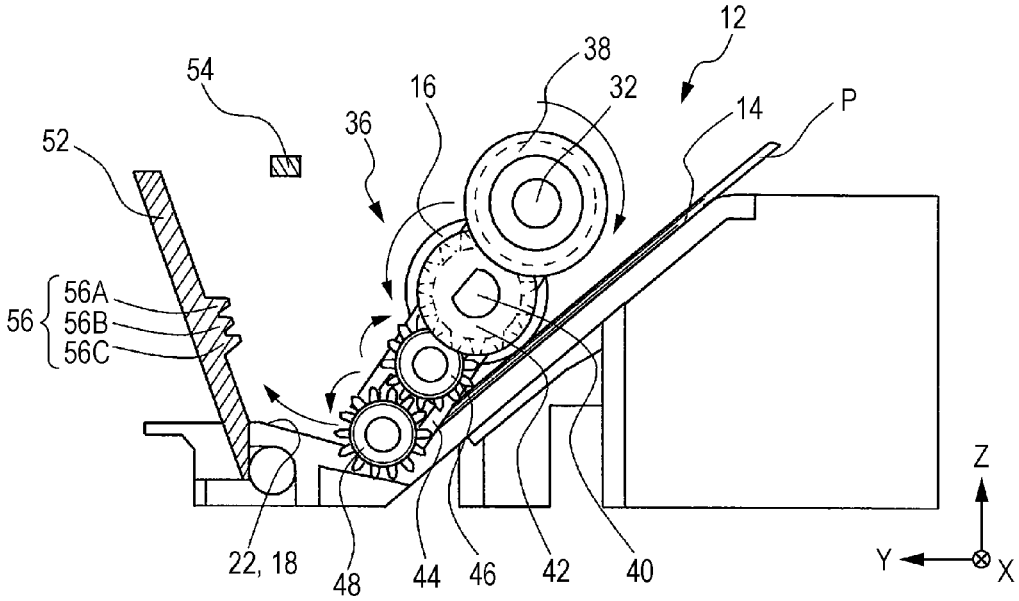
FIG. 7A is a side view of the feed roller which is in a state capable of feeding.
Figure 7B:
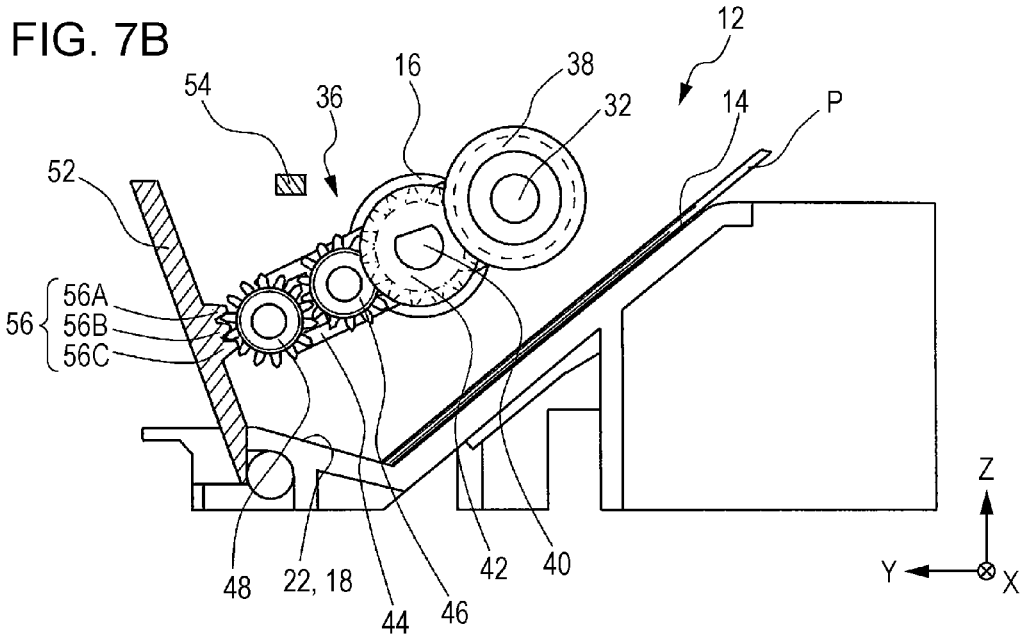
FIG. 7B is a side view of the feed roller separation mechanism which is in the engagement state during continuous feeding of the recording media.

FIG. 5A is a side view of the feed roller separation mechanism which is in a second position of the separating operation from the feeding path. FIG. 5B is a side view of the feed roller separation mechanism which is in a third position of the separating operation from the feeding path. FIG. 6A is a side view of the feed roller separation mechanism which is in an engagement state. FIG. 6B is a side view of the feed roller separation mechanism which is released from the engagement and is moving toward a recording medium. FIG. 7A is a side view of the feed roller which is in a state capable of feeding. FIG. 7B is a side view of the feed roller separation mechanism which is in the engagement state during continuous feeding of the recording media.

Although almost all the rollers on the sheet transportation path of the printer are shown as being located on the same plane in FIG. 1 for illustration purpose, the rollers are not necessarily located at the same position (some of the rollers may be located at the same position) in the depth direction (the direction perpendicular to the plane of FIG. 1). Further, in the x-y-z coordinate system used throughout the figures, X direction indicates a direction perpendicular to a sheet transportation direction (feeding direction), that is, a sheet width direction, Y direction indicates the sheet transportation direction (feeding direction), and Z direction indicates an apparatus height direction, that is, the gravity direction.

FIG. 1 shows a feeding device 12 of an ink jet printer 10 (hereinafter, referred to as "printer 10") as an example of recording apparatus of the invention. The feeding device 12 includes a loading surface 14 on which a paper sheet P which is an example of "recording medium" is placed, a pick-up roller 16 as an example of "feed roller" disposed at a position that opposes the loading surface 14, a separation section 18 that separates the paper sheets P, and a sheet return lever 20 that pushes the separated paper sheet P back to the loading surface 14.

The separation section 18 includes a first separation section 22 and a second separation section 24. A recording section 26 is disposed at a position downstream in the feeding path with respect to the separation section 18. The recording section 26 includes a recording head 28 and a lower guide member 30 that opposes the recording head 28.

The paper sheet P is placed on the inclined loading surface 14 of the feeding device 12 such that the leading edge of the paper sheet P comes into contact with the first separation section 22. The pick-up roller 16 is disposed on a first support member 34 that swings about a pivot shaft 32. In FIG. 1, reference numeral 16 indicates a state in which the pick-up roller 16 is in contact with the paper sheet P, while reference numeral 16' indicates a state in which the pick-up roller 16 has been moved away from the paper sheet P.

The pick-up roller 16 is configured to be displaced in directions to and away from the paper sheet P by the pivot shaft 32 that is driven by a drive motor which is not shown in the figure and the first support member 34. Further, the pick-up roller 16 is rotated by the drive motor so as to come into contact with the paper sheet P and feed the paper sheet P downstream of the feeding path.

The paper sheet P is fed downstream of the feeding path from the loading surface 14 with the leading edge thereof being in contact with the first separation section 22 until the leading edge reaches the second separation section 24. Then, the uppermost paper sheet P is separated from the subsequent paper sheets P by the first separation section 22 and the second separation section 24 so that only the uppermost paper sheet P is fed downstream of the feeding path. That is, the separation section 18 prevents double feeding of the paper sheets P. The separated subsequent paper sheets P are pushed back to the loading surface 14 when the sheet return lever 20

(see FIG. 1) which has been pressed in the downstream direction is pulled up in the upstream direction (see reference numeral 20' in FIG. 1).

The paper sheet P which has been fed downstream of the feeding path from the separation section 18 is then transported to the recording section 26 by a sheet transportation roller which is not shown in the figure. After being transported to the recording section 26, the paper sheet P is fed between the recording head 28 and the lower guide member 30 to face the recording head 28. The recording head 28 is disposed on the underside of a carriage which is not shown in the figure, and the carriage is driven to reciprocate in a main scan direction (the direction perpendicular to the plane of FIG. 1, that is, X axis direction) by a drive motor which is not shown in the figure. The lower guide member 30 supports the paper sheet P, thereby defining a distance between the paper sheet P and the recording head 28. After recording is performed in the recording section 26, the paper sheet P is ejected from the printer 10 by a transportation unit which is not shown in the figure.

First Embodiment

With reference to FIG. 2, a pick-up roller separation mechanism 36 according to the first embodiment of the invention will be described below in detail. The pick-up roller separation mechanism 36 includes the pivot shaft 32, the first support member 34, a first drive gear 38, a pick-up roller drive shaft 40 (hereinafter, referred to as "drive shaft 40"), a second drive gear 42, a second support member 44, a transmission gear 46 and an engagement gear 48.

The pivot shaft 32 extends in the X axis direction, that is, the width direction of the paper sheet P, at a position that opposes the loading surface 14. The pivot shaft 32 is rotated by the drive motor which is not shown in the figure. Further, the first drive gear 38 is disposed on one end of the pivot shaft 32. The drive shaft 40 that extends in the X axis direction is disposed in parallel with the pivot shaft 32 with a space from the pivot shaft 32.

The second drive gear 42 that mates with the first drive gear 38 is disposed on one end of the drive shaft 40, and the pick-up roller 16 is disposed on the other end of the drive shaft 40. As the drive shaft 40 rotates via the pivot shaft 32, the first drive gear 38 and the second drive gear 42 by the drive motor which is not shown in the figure, the pick-up roller 16 rotates with the drive shaft 40.

A pair of first support members 34 that support the pick-up roller 16 are provided on each side of the pick-up roller 16 in the axial direction of the pivot shaft 32 so as to be swingable about the pivot shaft 32. The drive shaft 40 is inserted through the first support member 34 on one end of the pivot shaft 32. The second support member 44 is disposed on the other end of the pivot shaft 32 so as to be swingable about the pivot shaft 32. Further, the drive shaft 40 is inserted through the second support member 44. The second support member 44 is disposed adjacent to the second drive gear 42 on the drive shaft 40.

The transmission gear 46 that mates with the second drive gear 42 and the engagement gear 48 that mates with the transmission gear 46 are rotatably mounted on the second support member 44. The engagement gear 48 which is a "first engagement section" also serves as a pinion gear of a rack 56, which will be described later. Further, a spring member 50 which is a "bias unit" is disposed in the second support member 44 so as to apply a biasing force between the drive shaft 40 and the second support member 44.

The spring member 50 applies a biasing force in a direction that crosses the axial direction of the pivot shaft 32 and the drive shaft 40 between the drive shaft 40 and the second support member 44, thereby applying a rotational friction resistance to the second drive gear 42 (and thus the engagement gear 48). Accordingly, in this embodiment, the rotational friction resistance can be applied to the engagement gear 48 with a simple configuration. Further, the rotational friction resistance causes the second drive gear 42 to rotate about the first drive gear 38 when the second drive gear 42 is rotated by the first drive gear 38.

Accordingly, the drive shaft 40 (and thus the first support member 34 and the second support member 44) swings about the pivot shaft 32. As a consequence, the pick-up roller 16 that is supported by the first support member 34 and the transmission gear 46 and the engagement gear 48 that are mounted on the second support member 44 swing about the pivot shaft 32 with the first support member 34 and the second support member 44. This swing causes the first support member 34 to displace the pick-up roller 16 in directions to and away from the paper sheet P.

Further, the first drive gear 38, the second drive gear 42, the transmission gear 46, the engagement gear 48 and the second support member 44 of the pick-up roller separation mechanism 36 are disposed outside of an area of the paper sheet P in the X axis direction.

With reference to FIG. 3, the feeding device 12 further includes a rack section 52 and a regulation section 54. The rack section 52 and the regulation section 54 are fixedly provided at positions that correspond to the engagement gear 48 and the second support member 44 in the X axis direction. The rack section 52 includes the rack 56 as a "second engagement section". The rack 56 is composed of a plurality of teeth 56A, 56B, 56C. Reference numerals 56A, 56B, 56C are denoted in sequence from the upper to lower position in the Z axis direction in FIG. 3.

Next, feeding of the paper sheet P by the pick-up roller 16 will be described. When the paper sheet P is fed downstream of the feeding path from the loading surface 14 by the feeding device 12, the first drive gear 38 is rotated in the counterclockwise direction in FIG. 3 by a drive motor which is not shown in the figure. As the first drive gear 38 rotates, the second drive gear 42 that mates with the first drive gear 38, the transmission gear 46 and the engagement gear 48 rotate in the arrow directions of FIG. 3.

At this time, the spring member 50 that biases the drive shaft 40 applies a rotational friction resistance in the counterclockwise direction in FIG. 3 to the second drive gear 42. The rotational friction resistance causes the second drive gear 42 to rotate about the first drive gear 38 in the counterclockwise direction in FIG. 3 as described above. As a consequence, the drive shaft 40 swings about the pivot shaft 32 in the counterclockwise direction in FIG. 3. This swing causes the pick-up roller 16 to be pressed against the surface of the paper sheet P. The pick-up roller 16 that rotates in the clockwise direction in FIG. 3 generates a friction force between the pick-up roller 16 and the surface of the paper sheet P that is in contact with the pick-up roller 16, thereby allowing the paper sheet P to be fed in the rotation direction of the pick-up roller 16, that is, downstream of the feeding path.

With reference to FIGS. 4A, 4B, 5A and 5B, a separating operation of the pick-up roller 16 from the paper sheet P will be described. FIG. 4A shows that the pick-up roller 16 is in contact with the surface of the paper sheet P.

Then, when the pick-up roller 16 is moved away from the surface of the paper sheet P, the first drive gear 38 is rotated by the drive motor which is not shown in the figure in the clockwise direction in FIG. 4A. As the first drive gear 38 rotates, the second drive gear 42, the transmission gear 46 and the engagement gear 48 rotate in the arrow directions of FIG. 4A.

At this time, the spring member 50 that biases the drive shaft 40 applies a rotational friction resistance in the clockwise direction in FIG. 4A to the second drive gear 42. The rotational friction resistance causes the second drive gear 42 to rotate about the first drive gear 38 in the clockwise direction in FIG. 4A. As a consequence, the drive shaft 40, the pick-up roller 16, the second support member 44, the transmission gear 46 and the engagement gear 48 swing about the pivot shaft 32 in the clockwise direction in FIG. 4A.

Accordingly, the pick-up roller separation mechanism 36 swings in a direction in which the pick-up roller 16 is moved away from the paper sheet P. That is, the pick-up roller separation mechanism 36 is displaced from the position shown in FIG. 4A to the position shown in FIG. 4B.

With reference to FIG. 4B, when the pick-up roller separation mechanism 36 swings about the pivot shaft 32 in the clockwise direction in FIG. 4B, the engagement gear 48 comes into contact with the lowermost tooth 56C of the rack 56 of the rack section 52. At this time, the engagement gear 48 rotates in the counterclockwise direction in FIG. 4B.

That is, a direction in which the engagement gear 48 moves with respect to the rack 56 by the swing of the second support member 44 (the upper left direction in FIG. 4) and a direction in which the teeth of the engagement gear 48 move with respect to the rack 56 by a rotation of the engagement gear 48 (the upper left direction in FIG. 4) are the same direction. Accordingly, since the engagement gear 48 does not suffer a significant resistance from the rack 56 when it moves on the rack 56, the engagement gear 48 can move on the rack 56 while smoothly engaging the rack 56.

Further, when the first drive gear 38 continues to rotate in the clockwise direction in FIG. 4B, the engagement gear 48 continues to rotate in the counterclockwise direction. This rotation causes the engagement gear 48 to be displaced upward on the rack 56 beyond the plurality of teeth 56A, 56B, 56C of the rack 56. That is, the drive shaft 40, the pick-up roller 16, the second support member 44, the transmission gear 46 and the engagement gear 48 further swing about the pivot shaft 32 in the clockwise direction in FIG. 4B from the position shown in FIG. 4B to the position above the rack 56 as shown in FIG. 5A.

After the engagement gear 48 moves beyond the rack 56, when the first drive gear 38 rotates in the clockwise direction in FIG. 5A, the drive shaft 40, the pick-up roller 16, the second support member 44, the transmission gear 46 and the engagement gear 48 are displaced from the position shown in FIG. 5A to the position shown in FIG. 5B. At this time, the second support member 44 comes into contact with the regulation section 54 that is disposed above the rack 56. As a consequence, the regulation section 54 prevents the second support member 44 (and thus the pick-up roller separation mechanism 36) from being displaced upward.

That is, the drive shaft 40, the pick-up roller 16, the second support member 44, the transmission gear 46 and the engagement gear 48 are not displaced further upward from the position shown in FIG. 5B even if the first drive gear 38 continues to rotate in the clockwise direction in FIG. 5B after the second support member 44 comes into contact with the regulation section 54.

When the second support member 44 comes into contact with the regulation section 54, the first drive gear 38 stops to rotate. Accordingly, the drive shaft 40 and the second drive gear 42 (and thus the engagement gear 48) also stop to rotate. That is, a power is not further transmitted from the first drive gear 38 to the second drive gear 42, the transmission gear 46 and the engagement gear 48. As a consequence, the pick-up roller separation mechanism 36 becomes unable to withstand the weight of components including the first support member 34 and the pick-up roller 16, specifically, the first support member 34, the drive shaft 40, the pick-up roller 16, the second support member 44, the second drive gear 42, the transmission gear 46 and the engagement gear 48, and is then displaced downward.

That is, the pick-up roller separation mechanism 36 moves from the position shown in FIG. 5B to the position shown in FIG. 6A. At this time, the spring member 50 applies a rotational friction resistance in the counterclockwise direction in FIG. 6A to the drive shaft 40, thereby serving as a brake. Accordingly, the pick-up roller separation mechanism 36 gradually moves to the position shown in FIG. 6A.

Further, a rotational friction resistance is applied to the engagement gear 48 that is in contact with the uppermost tooth 56A of the rack 56 in FIG. 6A. That is, the rotational friction resistance is applied to the engagement gear 48 in a direction that prevents the engagement gear 48 from mating with the teeth 56A, 56B, 56C of the rack 56. As a result, the engagement gear 48 is resistant to rotate in the clockwise direction in FIG. 6A in which the engagement gear 48 mates with the teeth 56A, 56B, 56C of the rack 56. Accordingly, the engagement gear 48 is maintained in a state being in contact with the tooth 56A of the rack 56 against the weight of the pick-up roller separation mechanism 36 when the power is not transmitted from the first drive gear 38.

Further, since the rack 56 has a plurality of teeth 56A, 56B, 56C, even if the engagement gear 48 is disengaged from the tooth 56A of the rack 56 due to an external factor such as vibration, the engagement gear 48 engages with the next tooth 56B, thereby maintaining engagement of the engagement gear 48 and the rack 56. Accordingly, the pick-up roller separation mechanism 36 is maintained in the position shown in FIG. 6A.

Next, an approaching operation of the pick-up roller separation mechanism 36 from a separated position (FIG. 6A) to a feeding position (FIG. 4A) will be described below. In FIG. 6A, the engagement gear 48 of the pick-up roller separation mechanism 36 and the uppermost tooth 56A of the rack 56 are engaged with each other. In this state, as the first drive gear 38 is rotated by the drive motor which is not shown in the figure in the counterclockwise direction in FIG. 6A, the engagement gear 48 is rotated in the clockwise direction in which the engagement gear 48 mates with the teeth 56A, 56B, 56C of the rack 56 against the rotational friction resistance in the counterclockwise direction.

As a result, the engagement gear 48 disengages from the rack 56 by the power from the first drive gear 38 and is displaced from the upper to lower position on the rack 56 beyond a plurality of teeth 56A, 56B, 56C of the rack 56. That is, the pick-up roller separation mechanism 36 is displaced from the position shown in FIG. 6A to the position shown in FIG. 6B.

Then, when the first drive gear 38 rotates in the counterclockwise direction in FIG. 6B, a rotational friction resistance in the counterclockwise direction is applied to the drive shaft 40 and the second drive gear 42. As a result, the second drive gear 42 swings about the pivot shaft 32 in the counterclockwise direction in FIG. 6B. Accordingly, the pick-up roller separation mechanism 36 is displaced from the position shown in FIG. 6B to the position shown in FIG. 4A, and the pick-up roller 16 presses the surface of the paper sheet P while feeding the paper sheet P downstream of the feeding path.

Moreover, when the engagement gear 48 engages with and disengages from a plurality of teeth 56A, 56B, 56C of the rack 56, a direction in which the engagement gear 48 moves with the first support member 34 with respect to the rack 56 is the same as a direction in which the engagement gear 48 rotates and a direction in which the engagement gear 48 mates with the teeth 56A, 56B, 56C of the rack 56. As a consequence, the engagement gear 48 can smoothly engage with and disengage from the teeth 56A, 56B, 56C of the rack 56. Accordingly, abrasion due to repeated engagement and disengagement of the engagement gear 48 and the rack 56 can be reduced, thereby maintaining a good engagement of the engagement gear 48 and the rack 56 for use over a long period of time.

Next, approaching and separating operation of the pick-up roller separation mechanism 36 during continuous feeding of the paper sheets P in the downstream direction of the feeding path will be described below. When the pick-up roller 16 is in a position capable of feeding the paper sheets P as shown in FIG. 7A, the first drive gear 38 is rotated by the drive motor which is not shown in the figure in the clockwise direction in FIG. 7A. As a result, a rotational friction resistance is applied to the drive shaft 40 and the second drive gear 42 in the clockwise direction. The rotational friction resistance causes the drive shaft 40 and the second drive gear 42 to swing about the pivot shaft 32 in the clockwise direction in FIG. 7A.

Accordingly, the pick-up roller separation mechanism 36 is displaced from the position shown in FIG. 7A in the clockwise direction to the upward position in FIG. 7A. As a result, the engagement gear 48 comes into contact with the lowermost tooth 56C of the rack 56. Since the engagement gear 48 rotates in the counterclockwise direction in FIG. 7A which is a direction in which the engagement gear 48 mates with the teeth 56A, 56B, 56C of the rack 56, the engagement gear 48 smoothly engages with the tooth 56C of the rack 56. Further, when the engagement gear 48 engages with the middle tooth 56B of a plurality of teeth of the rack 56 as shown in FIG. 7B, the first drive gear 38 stops to rotate. The engagement of the engagement gear 48 and the tooth 56B can be detected, for example, by a sensor (such as an optical rotary encoder) that detects a rotation angle of the second support member 44.

Since the rotational friction resistance is applied to the engagement gear 48 as described above, the engagement of the engagement gear 48 and the tooth 56B of the rack 56 is maintained. That is, the pick-up roller separation mechanism 36 is maintained in the position shown in FIG. 7B. Accordingly, the pick-up roller 16 is maintained in a position spaced away from the surface of the paper sheet P. Further, although a plurality of teeth of the rack 56 has been described as three teeth in this embodiment, the number of teeth is not limited thereto.

Then, the first drive gear 38 in the position shown in FIG. 7B is rotated in the counterclockwise direction in FIG. 7B, thereby displacing the pick-up roller 16 from the position spaced away from the paper sheet P as shown in FIG. 7B to the position for feeding the paper sheet P as shown in FIG. 7A. As a result, engagement of the engagement gear 48 and the rack 56 is released. At this time, a rotational friction resistance is applied to the drive shaft 40 and the second drive gear 42 in the counterclockwise direction in FIG. 7B. The pick-up roller separation mechanism 36 swings about the pivot shaft 32 in the counterclockwise direction in FIG. 7B. Accordingly, the pick-up roller 16 is displaced from the position spaced away from the paper sheet P to the feeding position of the paper sheet P.

Further, when the paper sheets P are continuously fed downstream of the feeding path, the area in which the pick-up roller separation mechanism 36 swings is defined from the feeding position shown in FIG. 7A to the separated position shown in FIG. 7B, thereby limiting the area in which the pick-up roller 16 swings. As a result, switching time between the feeding state and the separated state of the pick-up roller 16 can be reduced, thereby reducing decrease of throughput caused by waiting the pick-up roller 16 to be displaced.

To summarize the above description, the feeding device 12 includes the pick-up roller 16 that feeds the paper sheet P by rotating while coming into contact with the paper sheet P; the first support member 34 that supports the pick-up roller 16 and is configured to be swingable about the pivot shaft 32 so that the first support member 34 swings to displace the pick-up roller 16 in directions to and away from the paper sheet P; the engagement gear 48 that swings with the first support member 34; and the rack 56 that is fixedly provide and is engageable with the engagement gear 48, wherein engagement of the engagement gear 48 and the rack 56 is maintained against the weight of the pick-up roller 16 and the first support member 34 in a state where a power in a swing direction is not transmitted to the first support member 34, and engagement of the engagement gear 48 and the rack 56 is released when the power in the swing direction is transmitted to the first support member 34.

The engagement gear 48 is formed by a pinion gear with a rotational friction resistance applied thereto, and the rack 56 is configured to mate with the pinion gear and is composed of a plurality of teeth 56A, 56B, 56C. Further, the pivot shaft 32 is a rotation shaft that rotates by a power. The engagement gear 48 is configured to rotate by the power from the pivot shaft 32. Further, a direction in which the engagement gear 48 moves with respect to the rack 56 as the first support member 34 swings when the pick-up roller 16 is moved away from the paper sheet P and a direction in which the engagement gear 48 moves with respect to the rack 56 as the engagement gear 48 rotates are the same direction.

When the paper sheets P are continuously fed downstream of the feeding path, a swing range of the first support member 34 is limited between a position in which the pick-up roller 16 is in contact with the recording medium and a position in which the engagement gear 48 engages with the rack 56. Moreover, the feeding device 12 further includes a second support member 44 that swings with the first support member 34, and the drive shaft 40 that drives the pick-up roller 16. The second support member 44 includes the spring member 50 that applies a biasing force between the second support member 44 and the drive shaft 40 in a direction that crosses the axial direction of the drive shaft 40, and the spring member 50 applies the rotational friction resistance on the engagement gear 48.

Modification of First Embodiment (1) The engagement gear 48 may be disposed on the first support member 34 instead of on the second support member 44.

(2) The engagement gear 48 may be configured such that the power from the second drive gear 42 is indirectly transmitted via a belt or the like instead of the transmission gear 46.

(3) The rack 56 may be an one-way clutch.

Although the feeding device 12 of the invention is applied to the ink jet printer as an example of recording apparatus in this embodiment, the feeding device 12 may be applied to other liquid ejection apparatus in general. The liquid ejection apparatus is not limited to a recording apparatus such as a printer having an ink jet recording head and is configured to perform recording on the recording medium by ejecting ink from the recording head, a copying machine or a facsimile machine, and includes other apparatuses that eject liquid appropriate for its application instead of ink from a liquid ejection head that corresponds to the ink jet recording head on an ejection target medium that corresponds to the recording medium so that the liquid is applied on the ejection target medium.

The liquid ejection head is not limited to the recording head, and includes color material ejecting heads used for manufacturing color filters for liquid crystal displays and the like, electrode material (electric conductive paste) ejection heads used for forming electrodes for organic electroluminescence (EL) displays, field emission displays (FED) and the like, and bioorganic ejection heads used for manufacturing bio chips, and sample ejection heads as a fine pipette.

The invention is not limited the above embodiments, and various modifications can be made within the scope of the claims of the invention. It is needless to say that such modifications are within the scope of the invention.

The entire disclosure of Japanese Patent Application No. 2012-103318, filed Apr. 27, 2012, is expressly incorporated by reference herein.

What is claimed is:

1. A recording medium feeding device comprising:

a feed roller that feeds a recording medium by rotating while coming into contact with the recording medium, wherein the feed roller is disposed on a drive shaft;

a first support member that supports the feed roller and is configured to be swingable about a pivot shaft so that the first support member swings to displace the feed roller in directions to and away from the recording medium;

a first drive gear that is disposed on the pivot shaft;

a second drive gear that is disposed on the drive shaft;

a first engagement section that is formed by a gear that swings with the first support member, wherein the gear is connected to the first drive gear through the second drive gear;

a bias unit that applies a rotational friction resistance on the drive shaft; and a second engagement section that is engageable with the first engagement section when the first support member swings to move the feed roller away from the recording medium, wherein engagement of the first engagement section and the second engagement section is maintained in a state where a power in a swing direction is not transmitted to the first support member, and engagement of the first engagement section and the second engagement section is released when the power in the swing direction is transmitted to the first support member.

2. The recording medium feeding device according to claim 1, wherein engagement of the first engagement section and the second engagement section is established when the power in the swing direction is transmitted to the first support member.

3. The recording medium feeding device according to claim 1, wherein the first engagement section is formed by a pinion gear with a rotational friction resistance applied thereto, and the second engagement section is formed by a rack that mates with the pinion gear.

4. The recording medium feeding device according to claim 3, wherein the rack has a plurality of teeth.

5. The recording medium feeding device according to claim 1, wherein a swing range of the first support member is limited between a position in which the feed roller is in contact with the recording medium and a position in which the first engagement section engages with the second engagement section, when a plurality of recording media are continuously fed downstream of a feeding path.

6. The recording medium feeding device according to claim 3, wherein the pivot shaft is a rotation shaft that rotates by the power, the pinion gear is configured to rotate by the power from the pivot shaft, and a direction in which the pinion gear moves with respect to the rack as the first support member swings when the feed roller is moved away from the recording medium and a direction in which the pinion gear moves with respect to the rack as the pinion gear rotates are the same direction.

7. The recording medium feeding device according to claim 6, further comprising:

a second support member having the first engagement section that swings with the first support member; and wherein the drive shaft drives the feed roller, wherein the second support member includes a bias unit that applies a biasing force between the second support member and the drive shaft in a direction that crosses the axial direction of the drive shaft, and the bias unit applies the rotational friction resistance on the pinion gear.

* * * * *